US007860685B2

(12) United States Patent
Ho et al.

(10) Patent No.: US 7,860,685 B2
(45) Date of Patent: Dec. 28, 2010

(54) METHOD FOR CLUSTERING SIGNALS IN SPECTRA

(75) Inventors: Patrick Ho, Fremont, CA (US); Edward J. Gavin, San Jose, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 982 days.

(21) Appl. No.: 11/040,493

(22) Filed: Jan. 20, 2005

(65) Prior Publication Data

US 2005/0206363 A1 Sep. 22, 2005

Related U.S. Application Data

(60) Provisional application No. 60/540,741, filed on Jan. 30, 2004.

(51) Int. Cl.
*G01N 30/00* (2006.01)

(52) U.S. Cl. ..... 702/189; 702/23; 702/32; 250/282

(58) Field of Classification Search ..... 702/22–28, 702/30–32, 75–76, 189; 250/339.07, 339.11–12
See application file for complete search history.

(56) References Cited

U.S. PATENT DOCUMENTS

| | | | | |
|---|---|---|---|---|
| 4,885,697 | A * | 12/1989 | Hubner | 702/27 |
| 6,253,162 | B1 * | 6/2001 | Jarman et al. | 702/179 |
| 6,675,104 | B2 | 1/2004 | Gavin et al. | |
| 6,940,065 | B2 * | 9/2005 | Graber et al. | 250/282 |
| 2002/0102610 | A1 * | 8/2002 | Townsend et al. | 435/7.1 |
| 2003/0218130 | A1 | 11/2003 | Boschetti et al. | |
| 2005/0075797 | A1 * | 4/2005 | Wishart et al. | 702/22 |
| 2005/0267689 | A1 * | 12/2005 | Tsypin | 702/19 |

FOREIGN PATENT DOCUMENTS

| | | | |
|---|---|---|---|
| WO | WO 02/42733 | A2 | 5/2002 |
| WO | WO 200242733 | A2 * | 5/2002 |

OTHER PUBLICATIONS

U.S. Appl. No. 10/669,499, filed Sep. 23, 2003, Paulse et al.
U.S. Appl. No. 10/754,461, filed Jan. 8, 2004, Gavin et al.
Belu, A.M., et al., "Time-Of-Flight Secondary Ion Mass Spectrometry: Techniques and Applications for the Characterization of Biomaterial Surfaces," (Sep. 1, 2003), *Elsevier Science Publishers BV.*, Barking, GB, pp. 3635-3653, XP004431143, ISSN: 0142-9612 *p. 3641-3643*.
Slotta, D.J., et al., "Clustering Mass Spectrometry Data Using Order Statistics," *Proteomics*, (2003), vol. 3, pp. 1687-1691, XP002479978, Germany *abstract*, *p. 1688, last paragraph-p. 1689*.

* cited by examiner

*Primary Examiner*—Jeffrey R West
(74) *Attorney, Agent, or Firm*—Townsend and Townsend and Crew, LLP

(57) ABSTRACT

Methods for processing spectra are disclosed. The method includes obtaining a plurality of spectra, each spectrum in the plurality of spectra comprising a signal including a signal strength as a function of time-of-flight, mass-to-charge ratio, or a value derived from time-of-flight or mass-to-charge ratio. Then, a signal cluster is formed by clustering signals from the plurality of spectra with time-of-flights, mass-to-charge ratios, or values derived from time-of-flights or mass-to-charge ratios that are within a window that is defined using an expected signal width value.

20 Claims, 7 Drawing Sheets

FIRST PLURALITY OF SPECTRA: I vs. m/z

SECOND PLURALITY OF SPECTRA: I vs. m/z

METHOD FOR CLUSTERING SIGNALS IN SPECTRA

CROSS REFERENCE TO RELATED APPLICATIONS

This application claims the benefit of U.S. Patent Application No. 60/540,741, filed Jan. 30, 2004, entitled "METHOD FOR CLUSTERING SIGNALS IN SPECTRA," which disclosure is incorporated by reference herewith for all purposes.

BACKGROUND OF THE INVENTION

A "marker" typically refers to a polypeptide or some other molecule that differentiates one biological status from another. It is useful to identify novel markers for diagnostics and drug discovery processes. One way to discover if substances are markers for a disease is by determining if they are "differentially expressed" in biological samples from patients exhibiting the disease as compared to samples from patients not having the disease. For example, FIG. 1(A) shows one graph 100 of a plurality of overlaid mass spectra derived from samples from a group of 18 diseased patients. Another graph 102 is shown in FIG. 1(B) and illustrates a plurality of overlaid mass spectra derived from samples from a group of 18 normal patients. In each of the graphs 100, 102, signal intensity is plotted as a function of mass-to-charge ratio. The intensities of the signals shown in the graphs 100, 102 are proportional to the concentrations of markers having a molecular weight corresponding to the mass-to-charge ratio A in the samples. As shown in the graphs 100, 102, at the mass-to-charge ratio A, a number of signals are present in both pluralities of mass spectra.

When the signals in the graphs 100, 102 are viewed collectively, it is apparent that the average intensity of the signals at the mass-to-charge ratio A is higher in the samples from diseased patients than the average intensity of the signals at the mass-to-charge ratio A from the normal patient samples. The marker at the mass-to-charge ratio A is said to be "differentially expressed" in diseased patients, because the concentration of this marker is, on average, greater in samples from diseased patients than in samples from normal patients.

Mass spectra like those shown in FIGS. 1(A) and 1(B) can be used to form an analytical model, which can be used as a diagnostic tool. For example, with reference to the above example, a mass spectrum may be generated from an unknown sample from a test patient. The mass spectrum can be analyzed and the intensity of the signal at the mass-to-charge ratio A can be determined in the test patient's mass spectrum. The signal intensity can be compared to the average signal intensities at the mass-to-charge ratio A for diseased patients and normal patients. As shown in FIGS. 1(A) and 1(B), a prediction can then be made using this analytical model as to whether the unknown sample indicates that the test patient has or will develop the disease. For example, if the signal intensity at the mass-to-charge ratio A in the unknown sample is much closer to the average signal intensity at the mass-to-charge ratio A for the diseased patient spectra than for the normal patient spectra, then a prediction can be made that the test patient is more likely than not to develop or have the disease.

When forming more sophisticated analytical models, signals in mass spectra are often "clustered" together and are then further processed by a computer. For example, various signals associated with the different mass spectra at one or more mass-to-charge ratios can form one or more signal clusters. The signals forming the signal clusters may be further processed, for example, to identify markers and/or to form an analytical model. If, for example, it was not known that the mass-to-charge ratio A represented a differentially expressed marker in normal and diseased patients, a computer could cluster all 36 signals shown in FIGS. 1(A) and 1(B) together. The computer could thereafter determine that the mass-to-charge ratio A is a mass-to-charge ratio of interest. A statistical process running on the computer could be used to analyze the 36 signals in the signal cluster and could automatically determine that the marker that is associated with the mass-to-charge-ratio A is a differentially expressed marker.

Deciding which signals to include within a signal cluster is a problem. Different signal peaks with slightly different mass-to-charge ratios in respectively different mass spectra may in fact represent the same marker. Consequently, these signals are clustered together as a signal cluster and each of the signals in the signal cluster is treated as having the mass-to-charge ratio associated with the signal cluster, even though the signals are in fact associated with slightly different mass-to-charge ratios.

A "cluster window" can be used to capture all desired signals for a signal cluster. The cluster window is typically a continuous range of values such as time-of-flight values, mass-to-charge ratio values, or values derived therefrom. All signal peaks within the cluster window would form a signal cluster, and the signals in the signal cluster and the mass-to-charge ratio for the signal cluster would be used for further data analysis. The width of a cluster window was specified in terms of a percentage of the mass-to-charge ratio (e.g., 1% of a particular mass-to-charge ratio).

A problem with the cluster window is that it was not wide enough to capture all signals that should have been in the same signal cluster. If some signal peaks are incorrectly excluded in this clustering process, then any subsequent data analysis and model formation would also be incorrect. Accordingly, it is desirable to cluster signals correctly.

The cluster window could be widened so that more signals are included in a signal cluster. For example, the proportional growth rate of the cluster window could be increased as the time-of-flight or mass-to-charge ratio increases. However, doing so may upset the clustering of peaks at lower molecular masses. For example, at low time-of-flights or low mass-to-charge ratios, one might capture too many signals within a signal cluster if the cluster window is too wide. Signals associated with different markers could be erroneously included in the same cluster. This would also be undesirable. This potential solution would also require manual tuning on the part of the user, which is subjective and prone to human error.

Embodiments of the invention address these and other problems.

SUMMARY OF THE INVENTION

Embodiments of the invention are directed to methods for processing spectra such as mass spectra. Other embodiments of the invention are directed to computer readable media including code for processing spectra as well as systems that use the computer readable media.

One embodiment of the invention is directed to a method for processing spectra, the method comprising: (a) obtaining a plurality of spectra, each spectrum in the plurality of spectra comprising a signal including a signal strength as a function of time-of-flight, mass-to-charge ratio, or a value derived from time-of-flight or mass-to-charge ratio; and (b) forming a signal cluster by clustering signals from the plurality of spectra with time-of-flights, mass-to-charge ratios, or values derived from time-of-flights or mass-to-charge ratios that are within a window that is defined using an expected signal width value.

Another embodiment of the invention is directed to a method for processing spectra, the method comprising: (a) obtaining a first plurality of spectra, each spectrum in the first plurality of spectra comprising a signal including a signal strength as a function of time-of-flight, mass-to-charge ratio, or a value derived from time-of-flight or mass-to-charge ratio; (b) determining a peak value for each signal above a predetermined signal-to-noise ratio in the first plurality of spectra; (c) forming a first signal cluster by clustering signals from the plurality of spectra with time-of-flights, mass-to-charge ratios, or values derived from time-of-flights or mass-to-charge ratios that are within a first cluster window that is defined using a first expected signal width value; (d) determining a cluster center value using the peak values of the signals in the first signal cluster; and (e) forming a second signal cluster by clustering signals from the first plurality of spectra with time-of-flights, mass-to-charge ratios, or values derived from time-of-flights or mass-to-charge ratios that are within a second cluster window that is defined using the cluster center value and a second expected signal width value associated with the cluster center value.

Other embodiments of the invention are directed to computer readable media for processing spectra and systems for obtaining and processing spectra.

These and other embodiments of the invention are described below with reference to the drawings.

DETAILED DESCRIPTION

Figure 1A:
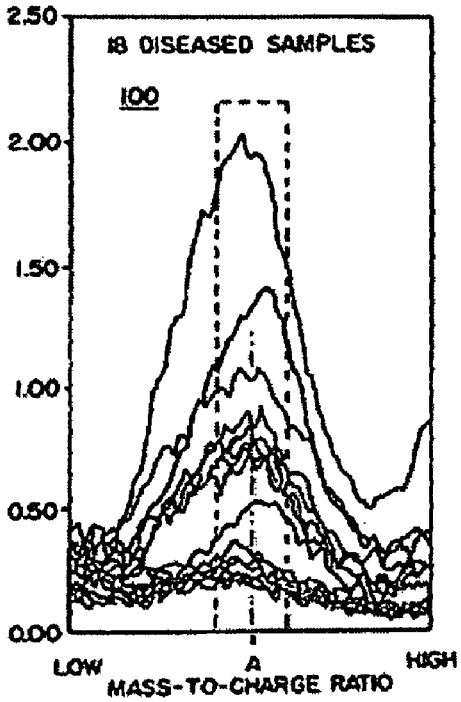
FIG. 1(A) shows a plurality of overlaid mass spectra from diseased samples.
Figure 1B:
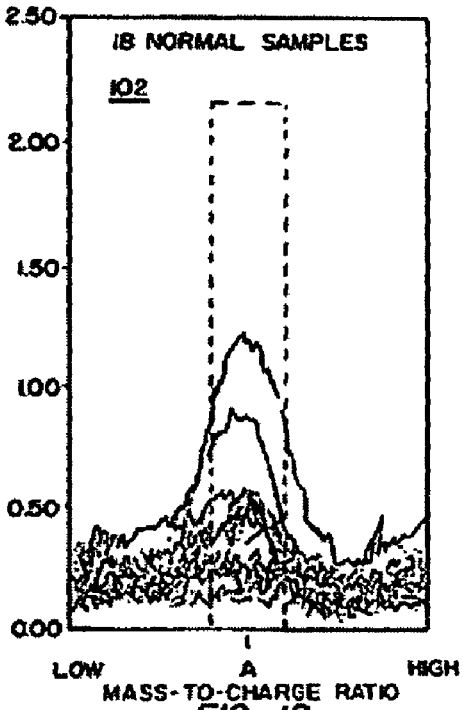
FIG. 1(B) shows a plurality of overlaid mass spectra from normal samples.

Some embodiments of the invention are directed to methods for processing spectra. The method comprises obtaining a plurality of spectra. Each spectrum in the plurality of spectra comprises a signal that is represented by signal strength as a function of time-of-flight, mass-to-charge ratio, or a value derived from time-of-flight or mass-to-charge ratio. An example of a "value derived from time-of-flight or mass-to-charge ratio" may be, for example, the mass of an ion.

In one type of mass spectrum display format, the signals in the mass spectrum are generally in the form of "peaks". After the spectra are obtained, one or more signal clusters are formed by selecting signals from the plurality of spectra with time-of-flights, mass-to-charge ratios, or values derived from time-of-flights or mass-to-charge ratios that are within the one or more corresponding cluster windows. The cluster windows are defined using expected signal width values. Expected signal width values are sometimes referred to as "expected peak width" values if the signals are in the form of peaks. After clustering the signals, the signals in the signal cluster and the mass-to-charge ratios associated therewith may be further processed or analyzed. In embodiments of the invention, there may be one, or two or more signal clusters per group of mass spectra.

Using an expected signal width value to determine the size of a cluster window is more desirable than the above-described way of defining the cluster window (e.g., by defining it in terms of a percentage of a mass-to-charge ratio). By using an expected signal width to determine the size of the cluster window, the non-linear relation of the signal width to the time-of-flight, mass-to-charge ratio, or value derived therefrom is automatically taken into account. Defining a cluster window in terms of expected signal width also has the added benefit of being more intuitive if the clustering algorithm fails for some reason. In embodiments of the invention, it is easy to see why the algorithm does not cluster two peaks (from different spectra) together when they are visually separated. It is also easier for a user to see that two adjacent signals overlap and are desirably included in the same signal cluster.

I. Expected Signal Widths

An "expected signal width" includes an expected signal dimension such as an expected or measured signal width. The expected signal width for a peak can be the width of a signal peak in a mass spectrum that is predicted at a given time-of-flight value or mass-to-charge ratio value (or value derived from such values) by the mass spectrometer.

If the signal is in the form a peak, the expected signal width can be measured from any suitable point along the height of a signal. In some embodiments, the expected signal width may be the expected width of the base of a signal peak, or may include a point between the apex and base of each signal peak. For instance, the signal widths that are used may be the signal widths at half the height of each signal peak. In another example, for a series of signals in a mass spectrum, the expected signal widths can be at a point between the apex and the base of each peak at the same distance from the baseline forming the bases of the peaks. In each case, the expected signal width generally increases as the time-of-flights, mass-to-charge ratios, or values derived from such values increase.

The expected signal widths can be theoretically or empirically derived. For example, a mass spectrum signal with a number of peaks corresponding to different analytes with known mass-to-charge values can be created, where the number of each of the different analytes is known to be approximately the same. The average time-of-flight value associated with each peak and the width of the peak can be recorded in a table of expected signal widths using analytes with known mass-to-charge values. An exemplary table of expected signal widths is shown in the Table below.

Table of Expected Signal Widths

| Time-of-flight (microseconds) | Expected Signal width (nanoseconds) |
|---|---|
| 0 | 4 |
| 60 | 80 |
| 94 | 600 |
| 132 | 2000 |
| 188 | 4000 |

Using the values in the Table, a best-fit curve can be created to fit the values in the Table. Alternatively, linear interpolations can be used to form a piecewise linear function that represents the data.

In another example, an equation such as the following can be used to determine expected signal width. In the following equation, $\bar{t}$ is the flight time of an ion, $\bar{v}_i$ is the average initial velocity, $\Delta v_i$ is the initial velocity spread, and d is the flight distance (e.g., the free flight distance in a mass spectrometer).

$$\Delta t \cong \frac{\bar{t}^3 \Delta v_i \bar{v}_i}{d^2}$$

Reasonable values to use with the above equation for predicting the width of a signal for some current mass spectrometers commercially available from Ciphergen Biosystems, Inc. are $\Delta v_i$=800 m/s, $\bar{v}_i$=750 m/s, and d=0.65 m. The window $\Delta t$ can be converted to a mass-to-charge ratio based window (i.e., $\Delta m/z$). As is well known in the art, mass-to-charge ratios can be readily determined using time-of-flight values. Other values for $\Delta v_i$, $\bar{v}_i$, and d could be used in other embodiments. For example, the value of d would be different for different mass spectrometers with different tube lengths.

Other methodologies can be used to determine expected signal widths for specific time-of-flight values or mass-to-charge ratio values.

II. Signal Clustering

Exemplary clustering methods can be described with reference to the flowchart shown in FIGS. 2(A)-2(B). In the examples below, signals that are a function of "mass-to-charge ratio" will be referred to for purposes of illustration. It is understood that other corresponding values such as time-of-flight or values derived from time-of-flight may be used instead of mass-to-charge ratio.

First, mass spectra are obtained (step 26). Any suitable process may be used to obtain the mass spectra. For example, the mass spectra may be retrieved (e.g., downloaded) from a local or remote server computer having access to one or more databases of mass spectra. The databases may contain libraries of mass spectra of different biological samples associated with different biological statuses. Alternatively, the mass spectra may be generated from the biological samples. Regardless of how they are obtained, the mass spectra and the samples used are preferably processed under similar conditions to ensure that any changes in the spectra are due to the biological factors, and not differences in processing.

Any suitable biological samples may be used in embodiments of the invention. Biological sample examples include tissue (e.g., from biopsies), blood, serum, plasma, nipple aspirate, urine, tears, saliva, cells, soft and hard tissues, organs, semen, feces, and the like. The biological samples may be obtained from any suitable organism including eukaryotic, prokaryotic, or viral organisms. Other examples of biological samples are described in the U.S. Pat. No. 6,675,104, which is herein incorporated by reference for all purposes.

In embodiments of the invention, a gas phase ion mass spectrometer may be used to create mass spectra. A "gas phase ion spectrometer" refers to an apparatus that measures a parameter that can be translated into mass-to-charge ratios of ions formed when a sample is ionized into the gas phase. This includes, e.g., mass spectrometers, ion mobility spectrometers, or total ion current measuring devices.

The mass spectrometer may use any suitable ionization technique. The ionization techniques may include for example, an electron ionization, fast atom/ion bombardment, matrix-assisted laser desorption/ionization (MALDI), surface enhanced laser desorption/ionization (SELDI), or electrospray ionization.

In preferred embodiments, a laser desorption time-of-flight mass spectrometer is used to create the mass spectra. Laser desorption spectrometry is especially suitable for analyzing high molecular weight substances such as proteins. For example, the practical mass range for a MALDI or SELDI process can be up to 300,000 daltons or more. Moreover, laser desorption processes can be used to analyze complex mixtures and have high sensitivity. In addition, the likelihood of protein fragmentation is lower in a laser desorption process such as a MALDI or SELDI process than in many other mass spectrometry processes. Thus, laser desorption processes can be used to accurately characterize and quantify high molecular weight substances such as proteins.

In a typical process for creating a mass spectrum, a probe with a marker is introduced into an inlet system of the mass spectrometer. The marker is then ionized. After the marker ions are generated, the generated ions are collected by an ion optic assembly, and then a mass analyzer disperses and analyzes the passing ions. The ions exiting the mass analyzer are detected by a detector. In a time-of-flight mass analyzer, ions are accelerated through a short high voltage field and drift into a high vacuum chamber. At the far end of the high vacuum chamber, the accelerated ions strike a sensitive detector surface at different times. Since the time-of-flight of the ions is a function of the mass-to-charge ratio of the ions, the elapsed time between ionization and impact can be used to identify the presence or absence or the quantity of molecules of specific mass-to-charge ratio.

Signals corresponding to the presence of a potential marker are identified in each spectrum. Each such signal is assigned a mass-to-charge ratio value. Signals above a predetermined signal-to-noise ratio are then detected to form a first plurality of mass spectra (step 28). In a typical example, signals with a signal-to-noise ratio greater than a value S may be detected. The value S may be an absolute or a relative value.

In embodiments of the invention, signals can be obtained in any suitable manner. In preferred embodiments, the signals are derived from analytes, including biological molecules such as nucleotides, amino acids, carbohydrates, simple lipids, polynucleotides (e.g., nucleic acids), polypeptides (e.g., proteins), polysaccharides (e.g., complex carbohydrates), complex lipids and conjugates of these (e.g., glycoproteins, lipoproteins and glycolipids).

A "peak value" for each signal in each mass spectrum is then determined (step 30). The peak value associated with a signal is the time-of-flight value, mass-to-charge ratio value, or any value derived from such values that corresponds to the tip or maximum intensity associated with a particular signal.

A first signal cluster is then formed using an expected signal width value (step 32). For example, a first cluster window can be formed using an expected signal width value. The width of the first cluster window may be the same or substantially the same as the expected signal width value at a particular mass-to-charge ratio. For example, the expected signal width at a mass-to-charge ratio X may be about 100 Daltons and the width of the first cluster window may also be about 100 Daltons wide. Signals with peak values that are within the first cluster window around X (X−50 Da to X+50 Da) form the first signal cluster. There may, of course, be more signal clusters per plurality of mass spectra.

A cluster center value is then determined for the signals in the first signal cluster (step 34). The cluster center value is determined using the peak values of the signals within the first signal cluster. In some embodiments, the center of the range of peak values associated with the first signal cluster may be used as a cluster center value. For example, if a first signal cluster comprises three signals with peak values 9,900 Da, 10,090 Da, and 10,100 Da, respectively, then the range of peak values would be from 9900 Da to 10,100 Da. The center (or midpoint) of that range would be 10,000 Da. In other embodiments, the cluster center value may be the average peak value for the peak values in the first signal cluster. For example, in the previously described example, the average of the peak values 9,000 Da, 10,090 Da, and 10,100 Da would be 10,030 Da, and the cluster center value would be 10,030 Da.

Figure 2A:
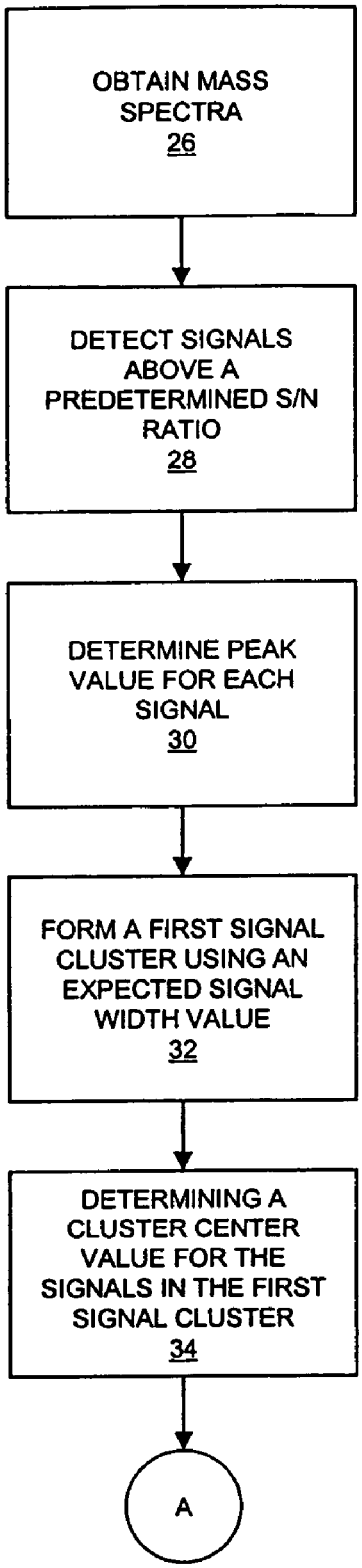
FIGS. 2(A)-2(B) show a flowchart illustrating a method according to an embodiment of the invention.
Figure 2B:
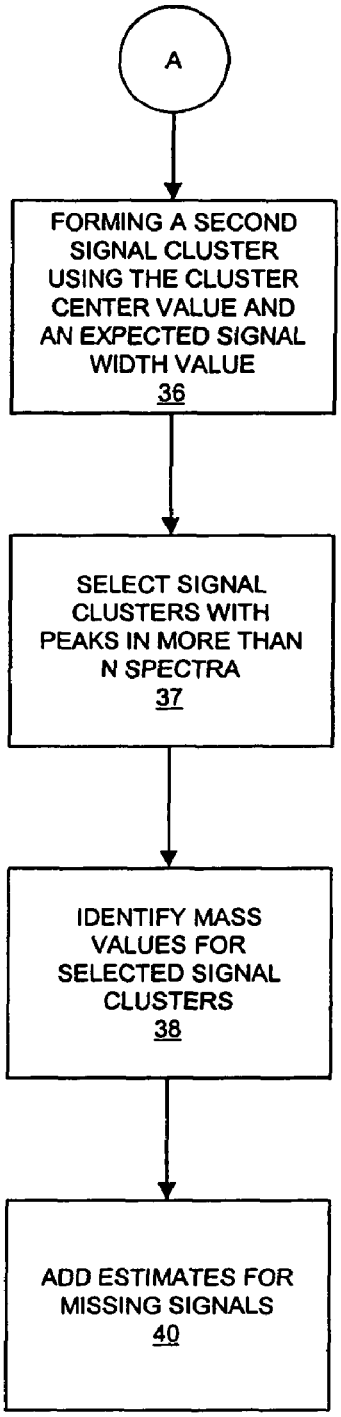

Referring to FIG. 2(B), a second signal cluster is formed using the cluster center value and a second expected signal width value at the cluster center value (step 36). The second expected signal width value is then used to determine a second cluster window that will be used for further clustering. The second cluster window is then centered about the cluster center value. All signals with peak values falling within the second cluster window will then form the second signal cluster, and the cluster center value may be assigned to each of the signals in the second signal cluster. There may be, of course, more than one signal cluster. The signals forming the first and second signal cluster may be the same or slightly different. The widths of the first and second cluster windows may be about the same or different.

After the second signal cluster is formed, signal clusters having a predetermined number of signals can be selected (step 37). Signal clusters having less than the predetermined number are discarded. In a typical example, if the number of signals in a signal cluster is less than 50% of the number of mass spectra, then the signal cluster can be discarded. In some embodiments, the selection process results in anywhere from as few as about 20 to more than about 200 selected signal clusters. This ensures that signal clusters of potential significance are selected for further analysis and processing. Once the signal clusters are selected, the mass-to-charge ratios for these signal clusters can be identified (step 38).

Once the mass-to-charge ratios are identified, "missing signals" for the mass-to-charge ratios can be determined. For example, some of the mass spectra may not exhibit a signal at the identified mass-to-charge ratios. This group of mass spectra or the samples associated with the mass spectra can be re-analyzed to determine if signals do in fact exist at the identified mass-to-charge ratios. Estimates are added for any missing signals (step 40). For spectra where no signal is found in a cluster, an intensity value is estimated from the trace height or noise value. The estimated intensity value may be user selectable.

Figure 3A:
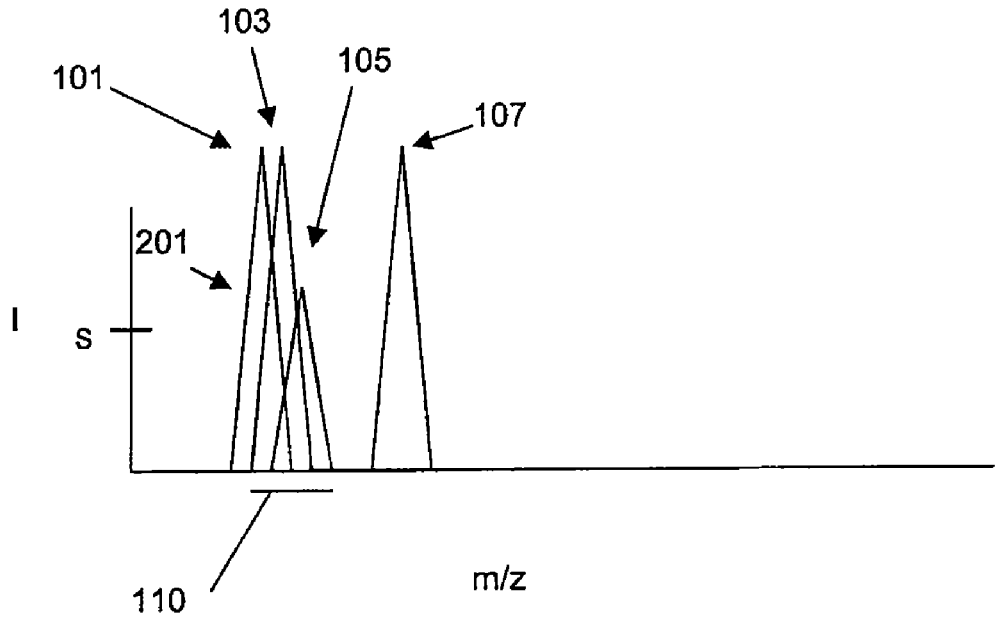
FIG. 3(A) shows a schematic illustration of a first plurality of mass spectra.
Figure 3B:
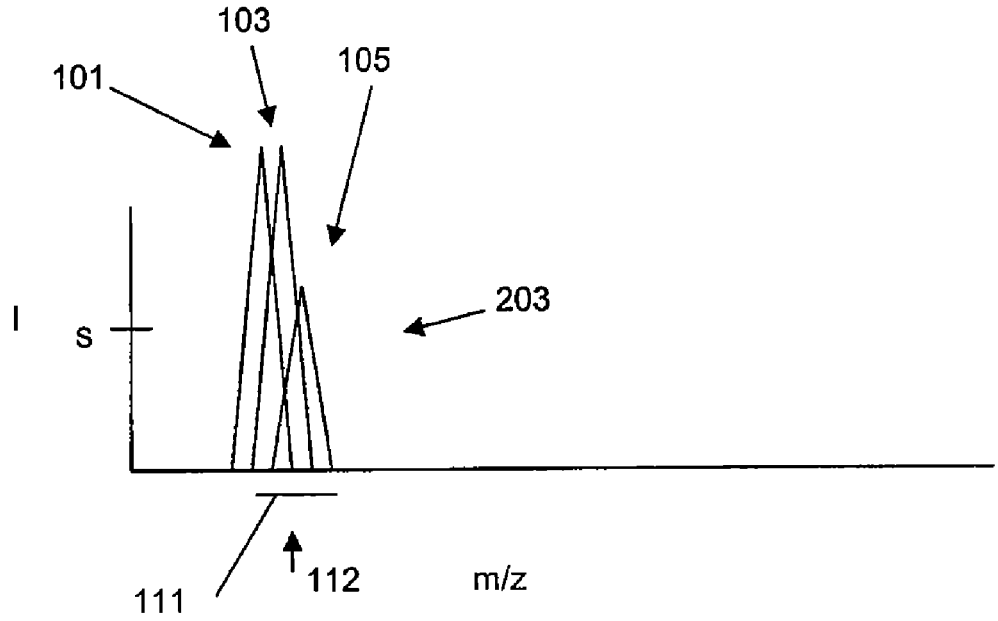
FIG. 3(B) shows a schematic illustration of a second plurality of mass spectra.

The steps shown in FIGS. 2(A) and 2(B) can be further described with reference to FIGS. 3(A) and 3(B), which respectively show schematic illustrations of a first plurality of mass spectra and a second plurality of mass spectra. Although FIGS. 3(A) and 3(B) show mass spectra displayed with signals in the form of peaks, it is understood that mass spectra can be displayed in other formats including data tables, bar charts, gel views (see, e.g., U.S. Pat. No. 6,675,104), etc.

With reference to FIG. 3(A), a first plurality of mass spectra may be obtained (step 26). The first plurality of mass spectra may comprise first, second, third, and fourth mass spectra, each mass spectrum comprising one signal 101, 103, 105, and 107 and each signal including one peak value. (There may be more than one signal per mass spectrum in other embodiments.) Only those signals above a predetermined signal-to-noise ratio, S, may be detected or displayed. Signals below the signal-to-noise ratio S may not be detected or may be removed (step 28). Peak values are then determined for the signals 101, 103, 105, and 107 (step 30). Exemplary peak values for signals 101, 103, 105, and 107 might be 10,000 Da, 10,005 Da, 10,020 Da, and 10,200 Da, respectively.

Referring to FIG. 2(A), a first signal cluster is formed using an expected signal width value (step 32). When forming the first signal cluster, an algorithm can compare two neighboring signals at a time, starting with the signals at the lowest and the second lowest mass-to-charge ratio. In FIG. 3(A), the expected signal width value at 10,000 Da may be 100 Da. A corresponding cluster window 110 that is about 100 Da wide may be applied to the center of the signals 101 and 103 and it will extend from 10,002.5 Da−50 Da=9,952.5 Da to 10,002.5 Da+50 Da=10,052.5 Da. Since the cluster window includes both signals 101 and 103, they are grouped together in a first cluster 201. Applying the same logic to signals 103 and 105, they are also grouped together in the same cluster, which means all three signals 101, 103, and 105 belong to cluster 201. The cluster window at the center of the signals 105 and 107 which extends from 10,110 Da−50 Da=10,060 Da to 10,110 Da+50 Da=10,160 Da however includes neither signal, and signal 107 is therefore not included in the first signal cluster 201.

As shown in FIG. 3(B), a cluster center value 112 is then determined for the first signal cluster (step 34). In this example, the cluster center value may be the centroid value for the first signal cluster, which would be 10,010 Da (i.e., 10,000 Da−10,020 Da/2).

A second signal cluster 203 is formed using this cluster center value 112 and a cluster window 111 is formed using second expected signal width value associated with that cluster center value 112. The expected signal width at the centroid value of 10,010 Da may be, for example, about 106 Da. In this example, the second cluster window 111 may be 106 Da wide and may be centered around 10,010 Da. The signals 101, 103, and 105 would fall within this second cluster window 111. Thus, in this example, the second signal cluster 203 includes the same signals 101, 103, and 105 as the first signal cluster 201.

Signal clusters with signals in more than N spectra may then be selected (step 37) for further data analysis and/or for further processing. For example, if N equals 3 or more signals, then the second signal cluster 203 comprising the signals 101, 103, 105 would be selected. The signal 107 would not belong to a signal cluster meeting the condition N equals 3 or more signals and would therefore be excluded from further data analysis, processing, and/or display. For instance, as shown in FIG. 3(B), a second plurality of mass spectra can be formed, without the extra signal 107.

The mass-to-charge ratio value associated with the cluster center value 112 for the second signal cluster 203 shown in FIG. 3(B) can then be selected (step 38). This cluster center value 112 may be used with the second signal cluster 203 for further processing and analysis. In this example, the cluster center value 112 associated with the second signal cluster 203 can be, for example, the centroid of the second signal cluster (10,010 Da) or the average mass-to-charge ratio of the signals in the second signal cluster. Estimates can be added for missing signals and the data in the second plurality of mass spectra can be normalized if desired.

In some embodiments, the signal intensities of the signals in the second signal cluster 203 can be placed in a spreadsheet (e.g., an Excel™ spreadsheet) and can be labeled with the mass-to-charge ratio associated with the cluster center value 112. The mass spectra and their associated signals may then be processed using one or more statistical analyses as described in further detail below.

In some embodiments, each signal 101, 103, and 105 may be marked with a red line (not shown) at the mass-to-charge ratio value corresponding to the cluster center value 112. This shows a user where the mass-to-charge ratio of the signal cluster is in relation to the peak value of the particular signal being viewed.

III. Additional Processing of Mass Spectra Data

Figure 4:
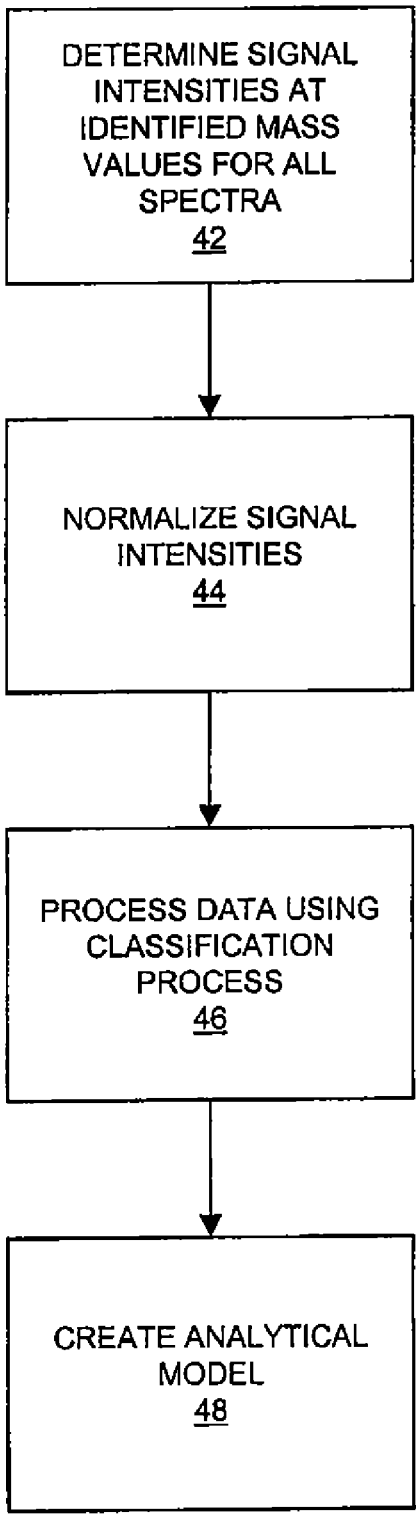
FIG. 4 shows a flowchart illustrating a method according to an embodiment of the invention.

Referring to FIG. 4, once mass-to-charge ratios are identified, signal intensity values can be determined for each signal at the identified mass-to-charge ratios for all mass spectra (step 42). The intensity value for each of the signals can be normalized from 0 to 100 to remove the effects of absolute magnitude (step 44).

In some embodiments, the log normalized data set is then processed by a classification process (step 46) that is embodied by code that is executed by a digital computer. After the code is executed by the digital computer, the analytical model (e.g., a classification model) is formed (step 48). The analytical model can use analysis processes such as hierarchical clustering, p-value plots, and multi-condition visualizations.

Statistical processes such as recursive partitioning processes can also be used to classify spectra. The spectra that are grouped together can be classified using a pattern recognition process that uses a classification model. In general, the spectra will represent samples from at least two different groups for which a classification algorithm is sought. For example, the groups can be pathological v. non-pathological (e.g., cancer v. non-cancer), drug responder v. drug non-responder, toxic response v. non-toxic response, progressor to disease state v. non-progressor to disease state, phenotypic condition present v. phenotypic condition absent.

In some embodiments, data derived from the spectra (e.g., mass spectra or time-of-flight spectra) that are generated using samples such as "known samples" can then be used to "train" a classification model. A "known sample" is a sample that is pre-classified. The data that are derived from the spectra and are used to form the classification model can be referred to as a "training data set". Once trained, the classification model can recognize patterns in data derived from spectra generated using unknown samples. The classification model can then be used to classify the unknown samples into classes. This can be useful, for example, in predicting whether or not a particular biological sample is associated with a certain biological condition (e.g., diseased vs. non diseased).

Classification models can be formed using any suitable statistical classification (or "learning") method that attempts to segregate bodies of data into classes based on objective parameters present in the data. Classification methods may be either supervised or unsupervised. Examples of supervised and unsupervised classification processes are described in Jain, "Statistical Pattern Recognition: A Review", IEEE Transactions on Pattern Analysis and Machine Intelligence, Vol. 22, No. 1, January 2000, which is herein incorporated by reference in its entirety.

In supervised classification, training data containing examples of known categories are presented to a learning mechanism, which learns one more sets of relationships that define each of the known classes. New data may then be applied to the learning mechanism, which then classifies the new data using the learned relationships. Examples of supervised classification processes include linear regression processes (e.g., multiple linear regression (MLR), partial least squares (PLS) regression and principal components regression (PCR)), binary decision trees (e.g., recursive partitioning processes such as CART-classification and regression trees), artificial neural networks such as backpropagation networks, discriminant analyses (e.g., Bayesian classifier or Fischer analysis), logistic classifiers, and support vector classifiers (support vector machines).

A preferred supervised classification method is a recursive partitioning process. Recursive partitioning processes use recursive partitioning trees to classify spectra derived from unknown samples. Further details about recursive partitioning processes are in U.S. Provisional Patent Application Nos. 60/249,835, filed on Nov. 16, 2000, and 60/254,746, filed on Dec. 11, 2000, and U.S. Non-Provisional patent application Ser. No. 09/999,081, filed Nov. 15, 2001, now U.S. Pat. No. 6,675,104, and Ser. No. 10/084,587, filed on Feb. 25, 2002. All of these U.S. Provisional and Non Provisional patent applications, and U.S. patents are herein incorporated by reference in their entirety for all purposes.

In other embodiments, the classification models that are created can be formed using unsupervised learning methods. Unsupervised classification attempts to learn classifications based on similarities in the training data set, without pre classifying the spectra from which the training data set was derived. Unsupervised learning methods include statistical cluster analyses. A statistical cluster analysis attempts to divide the data into groups that ideally should have members that are very similar to each other, and very dissimilar to members of other groups. Similarity is then measured using some distance metric, which measures the distance between data items, and groups together data items that are closer to each other. Statistical clustering techniques include the MacQueen's K-means algorithm and the Kohonen's Self-Organizing Map algorithm.

IV. Systems

All or some of the steps in FIGS. 2(A)-2(B) and 4 may be performed by a system including a digital computer. Moreover, all of the functions described in FIGS. 2(*a*)-2(*b*) and 4 and generally in this application may be readily programmed as computer code by those of ordinary skill in the art so that any of the described processes can be performed using the system.

Figure 5:
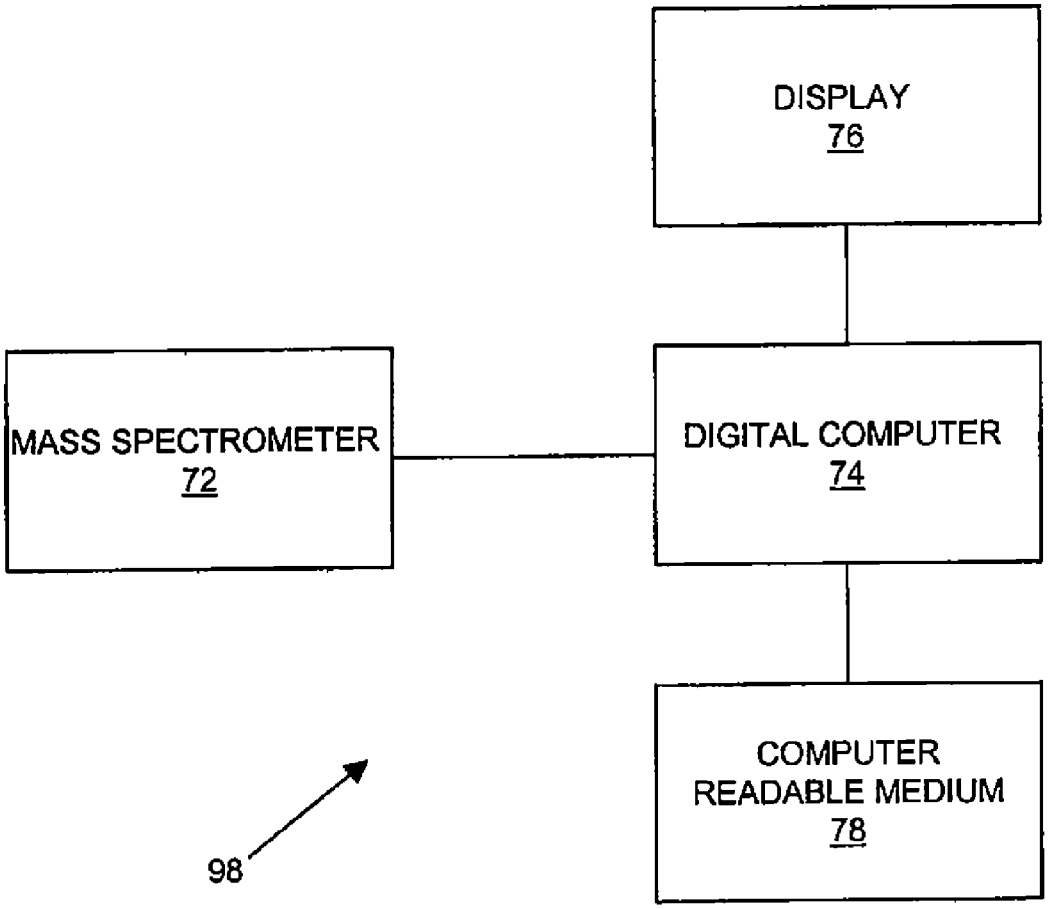
FIG. 5 shows a block diagram of a system according to an embodiment of the invention.

A block diagram of an exemplary system incorporating a computer readable medium and a digital computer is shown in FIG. 5. The system 98 includes a mass spectrometer 72 coupled to a digital computer 74. A display 76 such as a video display and a computer readable medium 78 may be operationally coupled to the digital computer 74. The display 76 may be used for displaying output produced by the digital computer 74. The computer readable medium 78 may be used for storing instructions to be executed by the digital computer 74. The digital computer 74 may use a Windows™ or other type of operating system.

The mass spectrometer 72 can be operably associated with the digital computer 74 without being physically or electrically coupled to the digital computer 74. For example, data from the mass spectrometer could be obtained (as described above) and then the data may be manually or automatically entered into the digital computer 74 using a human operator. In other embodiments, the mass spectrometer 72 can automatically send data to the digital computer 74 where it can be processed. For example, the mass spectrometer 72 can produce raw data (e.g., time-of-flight data) from one or more biological samples. The data may then be sent to the digital computer 74 where it may be pre-processed or processed. Instructions for processing the data may be obtained from the computer readable medium 78. After the data from the mass spectrometer is processed, an output may be produced and displayed on the display 76.

The computer readable medium 78 may contain any suitable instructions for processing the data from the mass spectrometer 72. For example, the computer readable medium 78 may include computer code for entering data obtained from a mass spectrum of an unknown biological sample into the digital computer 74. The data may then be processed using any of the above-described steps. Although the block diagram shows the mass spectrometer 72, digital computer 74, display 76, and computer readable medium 78 in separate blocks, it is understood that one or more of these components may be present in the same or different housings. For example, in some embodiments, the digital computer 74 and the computer readable medium 78 may be present in the same housing, while the mass spectrometer 72 and the display 76 are in different housings. In yet other embodiments, all of the components 72, 74, 76, 78 could be formed into a single unit.

Any of the functions described herein can be embodied by computer code that can be executed by the digital computer 74 or stored on the computer readable medium 78. The code may be stored on any suitable computer readable media. Examples of computer readable media include magnetic, electronic, or optical disks, tapes, sticks, chips, etc. The code may also be written in any suitable computer programming language including, C, C++, Java, Fortran, Pascal, etc.

Figure 6:
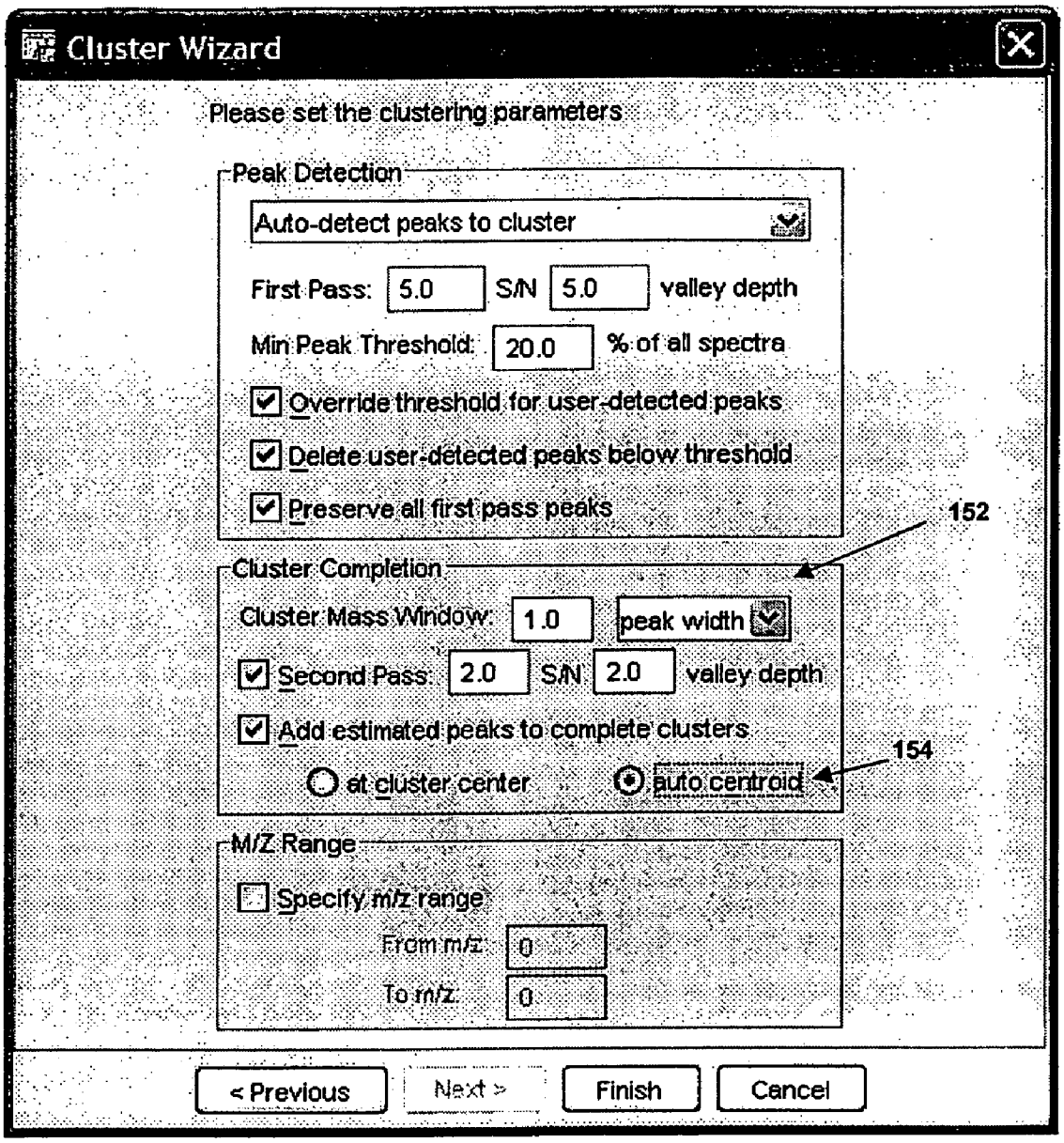
FIG. 6 shows an example of a graphical user interface that can be used in embodiments of the invention.

FIG. 6 shows an exemplary graphical user interface that can be used in embodiments of the invention. As shown, a drop down window 152 may be provided to allow an operator to select an "expected signal width" (or expected peak width if the signals are in the form of peaks) for defining a cluster window. Other suitable graphical user interfaces are described in U.S. Provisional Patent Application No. 60/443,071, filed on Jan. 27, 2003, and U.S. patent application Ser. No. 10/754,461, entitled "Data Management System and Method for Processing Signals from Sample Spots", filed on Jan. 8, 2004, which are both herein incorporated by reference in their entirety for all purposes.

FIG. 6 also provides for an auto centroid feature 154. As noted above, the signals in a signal cluster may be marked with a mass-to-charge-ratio value associated with that signal cluster. This can sometimes result in markings that are shifted from the tips of the signal peaks. Improvements can be achieved by automatically applying the existing peak peak detection algorithm to try and find an apex instead of just using a fixed mass-to-charge ratio value. This algorithm would automatically find the apex of the peak and mark it in a color such as red.

Cluster editing functions can also be provided in the software in the system. Cluster editing allows a user to directly edit signal clusters. Cluster editing functions can comprise a cluster selection cue in a spectrum viewer. Signals in a selected signal cluster in the cluster table are highlighted in red while the rest are in gray for easy distinction of which peaks belong to the same cluster. This also flags the current cluster that is being edited. The cluster editing functions also include a feature which allows a user to directly adjust ("move") signal peaks within a signal cluster, and a tool to delete signal clusters (e.g., allows a user to delete clusters with high p-values). Yet another cluster editing function is a cluster index/peak type display function. This includes an additional mode that allows one to directly examine a cluster index and whether the peak was identified in the first or second signal cluster or an estimated signal.

While the foregoing is directed to certain preferred embodiments of the present invention, other and further embodiments of the invention may be devised without departing from the basic scope of the invention. Such alternative embodiments are intended to be included within the scope of the present invention. Moreover, the features of one or more embodiments of the invention may be combined with one or more features of other embodiments of the invention without departing from the scope of the invention.

For example, although FIGS. 2(A)-2(B) and 4 illustrate preferred orders of processing steps, embodiments of the invention are not limited to the particular order of steps shown in these FIGS. For example, with reference to FIG. 2(A), it is possible to form a first signal cluster (step 32) before determining the peak values for the signals (step 30) in other embodiments of the invention.

All publications and patent documents cited in this application are incorporated by reference in their entirety for all purposes to the same extent as if each individual publication or patent document were so individually denoted. By his citation of various references and providing background descriptions in this document Applicant does not admit that any particular reference or any particular description herein is "prior art".

What is claimed is:

1. A method for processing spectra, the method comprising:

(a) obtaining a plurality of spectra, each spectrum in the plurality of spectra comprising a signal including a signal strength as a function of time-of-flight, mass-to-charge ratio, or a value derived from time-of-flight or mass-to-charge ratio;

(b) forming, with a computer, a signal cluster by clustering signals from the plurality of spectra with time-of-flights, mass-to-charge ratios, or values derived from time-of-flights or mass-to-charge ratios that are within a window that is defined using an expected signal width value;

(c) determining a cluster center value associated with the signal cluster; and (d) creating an analytical model using the cluster center value, wherein the analytical model is capable of classifying samples into classes associated with different conditions, wherein the signal cluster is a first signal cluster, the window is a first cluster window, and the expected signal width is a first expected signal width, and wherein the method further includes forming a second signal cluster using a second cluster window, the second cluster window being defined using a second expected signal width.

2. The method of claim 1 wherein the plurality of spectra is a first plurality of spectra and wherein the method further comprises:

forming a second plurality of spectra using at least some of the signals in the first signal cluster.

3. The method of claim 1 wherein the method further comprises:

forming a plurality of signal clusters; and selecting signal clusters in the plurality of signal clusters that have signals equal to or exceeding a predetermined number of signals.

4. The method of claim 1 further comprising forming a second plurality of spectra using at least some of the signals in the signal cluster, and wherein forming the second plurality of spectra comprises adding estimates for missing signals.

5. The method of claim 1 further comprising:

generating the plurality of spectra using a mass spectrometer.

6. A method for processing spectra, the method comprising:

(a) obtaining a plurality of spectra, each spectrum in the plurality of spectra comprising a signal including a signal strength as a function of time-of-flight, mass-to-charge ratio, or a value derived from time-of-flight or mass-to-charge ratio;

(b) forming, with a computer, a signal cluster by clustering signals from the plurality of spectra with time-of-flights, mass-to-charge ratios, or values derived from time-of-flights or mass-to-charge ratios that are within a window that is defined using an expected signal width value, wherein the method further comprises assigning a time-of-flight, a mass-to-charge ratio, or a value derived from time-of-flight or mass-to-charge ratio to the signals in the signal cluster, wherein the signal cluster is a first signal cluster, the window is a first cluster window, and the expected signal width is a first expected signal width, and wherein the method further includes forming a second signal cluster using a second cluster window, the second cluster window being defined using a second expected signal width.

7. A method for processing spectra, the method comprising:

(a) obtaining a first plurality of spectra, each spectrum in the first plurality of spectra comprising a signal including a signal strength as a function of time-of-flight, mass-to-charge ratio, or a value derived from time-of-flight or mass-to-charge ratio;

(b) determining a peak value for each signal above a predetermined signal-to-noise ratio in the first plurality of spectra;

(c) forming, with a computer, a first signal cluster by clustering signals from the first plurality of spectra with time-of-flights, mass-to-charge ratios, or values derived from time-of-flights or mass-to-charge ratios that are within a first cluster window that is defined using a first expected signal width value;

(d) determining a cluster center value using the peak values of the signals in the first signal cluster;

(e) forming a second signal cluster by clustering signals from the first plurality of spectra with time-of-flights, mass-to-charge ratios, or values derived from time-of-flights or mass-to-charge ratios that are within a second cluster window that is defined using the cluster center value and a second expected signal width value associated with the cluster center value; and (f) creating an analytical model using the cluster center value, wherein the analytical model is capable of classifying samples into classes associated with different conditions.

8. The method of claim 7 wherein the first and second cluster windows have the same or approximately the same width.

9. The method of claim 7 wherein the first signal cluster and the second signal cluster comprise the same signals.

10. The method of claim 7 wherein (c) is performed before (b).

11. The method of claim 7 further comprising:

generating the plurality of spectra using a mass spectrometer.

12. A non-transitory computer readable medium comprising:

code for obtaining a plurality of spectra, each spectrum in the plurality of spectra comprising a signal including a signal strength as a function of time-of-flight, mass-to-charge ratio, or a value derived from time-of-flight or mass-to-charge ratio;

code for forming a signal cluster by clustering signals from the plurality of spectra with time-of-flights, mass-to-charge ratios, or values derived from time-of-flights or mass-to-charge ratios that are within a window that is defined using an expected signal width value;

code for determining a cluster center value associated with the signal cluster;

code for creating an analytical model using the cluster center value, wherein the analytical model is capable of classifying samples into classes associated with different conditions; and wherein the signal cluster is a first signal cluster, the window is a first cluster window, and the expected signal width is a first expected signal width, and wherein the computer readable medium further comprises code for forming a second signal cluster using a second cluster window, the second cluster window being defined using a second expected signal width.

13. The computer readable medium of claim 12 wherein the plurality of spectra are mass spectra.

14. The computer readable medium of claim 12 wherein the plurality of spectra is a first plurality of spectra and wherein the computer readable medium further comprises:

code for forming a second plurality of spectra using at least some of the signals in the first signal cluster.

15. The computer readable medium of claim 12 wherein the computer readable medium further comprises:

code for forming a plurality of signal clusters; and code for selecting signal clusters in the plurality of signal clusters that have signals equal to or exceeding a predetermined number of signals.

16. The computer readable medium of claim 12 further comprising:

code for forming a second plurality of spectra, and code for adding estimates for missing signals.

17. A system comprising:

a gas phase ion spectrometer;

a digital computer adapted to process data from the gas phase ion spectrometer; and the computer readable medium of claim 12 coupled to the digital computer.

18. A non-transitory computer readable medium comprising:

code for obtaining a first plurality of spectra, each spectrum in the first plurality of spectra comprising a signal including a signal strength as a function of time-of-flight, mass-to-charge ratio, or a value derived from time-of-flight or mass-to-charge ratio;

code for determining a peak value for each signal above a predetermined signal-to-noise ratio in the first plurality of spectra;

code for forming a first signal cluster by clustering signals from the first plurality of spectra with time-of-flights, mass-to-charge ratios, or values derived from time-of-flights or mass-to-charge ratios that are within a first cluster window that is defined using an expected signal width value;

code for determining a cluster center value using the peak values of the signals in the first signal cluster;

code for forming a second signal cluster by clustering signals from the first plurality of spectra with time-of-flights, mass-to-charge ratios, or values derived from time-of-flights or mass-to-charge ratios that are within a second cluster window that is defined using the cluster center value and an expected signal width value associated with the cluster center value; and code for creating an analytical model using the cluster center value, wherein the analytical model is capable of classifying samples into classes associated with different conditions.

19. The computer readable medium of claim 18 wherein the first plurality of spectra are mass spectra.

20. A system comprising:

a gas phase ion spectrometer;

a digital computer adapted to process data from the gas phase ion spectrometer; and a non-transitory computer readable medium comprising:

code for obtaining a first plurality of spectra, each spectrum in the first plurality of spectra comprising a signal including a signal strength as a function of time-of-flight, mass-to-charge ratio, or a value derived from time-of-flight or mass-to-charge ratio;

code for determining a peak value for each signal above a predetermined signal-to-noise ratio in the first plurality of spectra;

code for forming a first signal cluster by clustering signals from the first plurality of spectra with time-of-flights, mass-to-charge ratios, or values derived from time-of-flights or mass-to-charge ratios that are within a first cluster window that is defined using an expected signal width value;

code for determining a cluster center value using the peak values of the signals in the first signal cluster; and code for forming a second signal cluster by clustering signals from the first plurality of spectra with time-of-flights, mass-to-charge ratios, or values derived from time-of-flights or mass-to-charge ratios that are within a second cluster window that is defined using the cluster center value and an expected signal width value associated with the cluster center value, wherein the computer readable medium is coupled to the digital computer.

* * * * *